United States Patent [19]

Vitalini

[11] 4,184,296

[45] Jan. 22, 1980

[54] PREFABRICATED PRISMATIC STRUCTURE FOR BUILDING

[76] Inventor: Alberto Vitalini, 13840 NE. 11th Ave., North Miami, Fla. 33161

[21] Appl. No.: 843,446

[22] Filed: Oct. 18, 1977

[30] Foreign Application Priority Data

Oct. 20, 1976 [IT] Italy ..... 51644 A/76

[51] Int. Cl.[2] ..... E04B 1/348

[52] U.S. Cl. ..... 52/79.4; 52/79.7; 52/79.13; 52/236.7

[58] Field of Search ..... 52/79.1, 79.2, 79.3, 52/79.4, 79.7, 236.9

[56] References Cited

U.S. PATENT DOCUMENTS

| | | | |
|---|---|---|---|
| 3,455,075 | 7/1969 | Frey | 52/79.7 |
| 3,484,999 | 12/1969 | van der Lely | 52/79.7 |
| 3,818,654 | 6/1974 | Schramm | 52/79.3 |

FOREIGN PATENT DOCUMENTS

| | | | |
|---|---|---|---|
| 42958 | 3/1960 | Poland | 52/236.9 |
| 1441815 | 7/1976 | United Kingdom | 52/79.1 |

*Primary Examiner*—John E. Murtagh

*Attorney, Agent, or Firm*—Stevens, Davis, Miller & Mosher

[57] ABSTRACT

Prefabricated skeletal building structure comprising at least three pillars connecting a lower base and an upper base, said bases having equal polygonal shapes, said upper base defining means to support flooring.

11 Claims, 17 Drawing Figures

PREFABRICATED PRISMATIC STRUCTURE FOR BUILDING

The invention relates to prefabricated skeletal structures for use in a construction system. More particularly, it relates to prefabricated skeletal structures either in reinforced concrete or in iron having various shaped bases and with especially formed upper beam-frames that support the surrounding floors and upper structures of multistory buildings.

The structures have dimensions which not only permit prefabrication for assembly to various room sizes but also comply with laws regulating the widths of loads to be transported on the highways.

Much progress has been made in the field of ordinary housing where supporting structures are generally completed on construction site by means of prefabricated roofs or floor panels, dividing and exterior panels.

Even in the prefabrication of supporting structures, studies have intensified, as has implementation of the same with the purpose of eliminating various disadvantages so as to further industrialize the building trade. At present, constuction of prefabricated supporting structures is effected by three systems:

1. By building pillars, beam, roof and floor panels at the plant, by transporting them, and by assembling them on the job site.

2. By building both vertical and horizontal supporting panels, transporting them to the work site where, by a different method of assemblage, they are joined together.

3. By means of factory-completed box-type supporting structures.

The advantages of the first two methods of prefabrication are recognized by the ease of transportation of component parts and multiple-type construction made possible by the modular elements of these structures. The principal disadvantages are that the various units are not joined in an ideally static manner and all refinishing facets of the construction are executed completely during the building, with the result that there is no consequential economic advantage in the utilization of the two systems.

On the other hand, the advantages of the box-type system are guaranteed static holding of the joints and other connecting parts, and the possibility of factory refinishing. The principal disadvantage is transportation with reference to the bulk of tridimensional units, and the way of assemble.

At present prefabrication of tridimensional residential structures is used in the production of light box-type structures (mobil homes) and of heavy box-type structures of reinforced concrete, having the walls and the lower and the upper floor panels in a single block.

The light box-type structures of wood are not used for multistory buildings because of the material used and its vulnerability to fire. The heavy ones of reinforced concrete have a limited field of application due to their excessive weight and transportation difficulties which limit their width to just eight feet.

In view of the foregoing it is an object of the invention to provide skeletal structures of reduced weight which may be more easily transported and assembled.

Another object of the invention is to provide skeletal structures which will enable an assembled unit to have its smallest dimension greater than eight feet.

A further object is to provide larger structures at less cost. Briefly stated these objects are accomplished by skeletal prefabricated structures of reinforced concrete or other materials which are triangular, rhomboidal, rectangular and trapezoidal prisms. They are composed of three or four pillars which connect triangular, rhomboidal, etc., bases. The bases consist of beam-frames. The lower beam-frames does not support any floor-pane, as is usually the case in ordinary structures. The upper beam-frame supports both the floor-panels and similar structures placed on top.

These structures have been developed because, placed in along with interposed floor-panels, they permit the building of solid constructions in short spaces of time. Structural prisms such as the triangular or rhomboidal prisms have been developed because, when they are placed in a proper manner at the construction site, their spans between pillars are greater than those that may be obtained with present polyhedral box-type structures.

The advantages of the construction system are as follows:

1. The relatively less weight per cubic yard of the polyhedral structure.

2. Flexibility with respect to room arrangement, measurement requirements and desirable methods of completing the interior space.

3. Rapidity of assembling the structures.

4. Strength of the construction because the structural components are monolithic and self-supporting.

5. The transportability inside the skeletal prisms of other prefabricated complementary parts (floor-panels, wall-panels, baths, etc.).

6. Reversible construction procedures whereby it will be possible to disassemble partially or completely the construction and to use again the already used elements.

For a better understanding of the invention as well as other objects and further features thereof reference is made to the following detailed description to be read in conjunction with the accompanying drawings in which.

Figure 1:
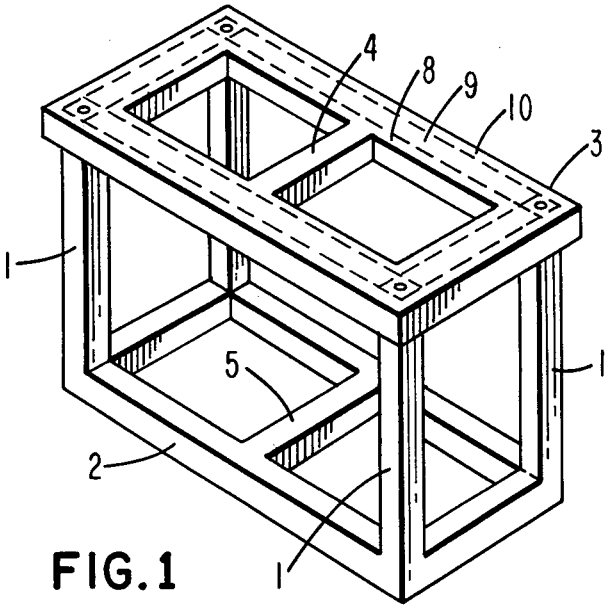
FIG. 1 is a perspective view of one embodiment of the invention.
Figure 2:
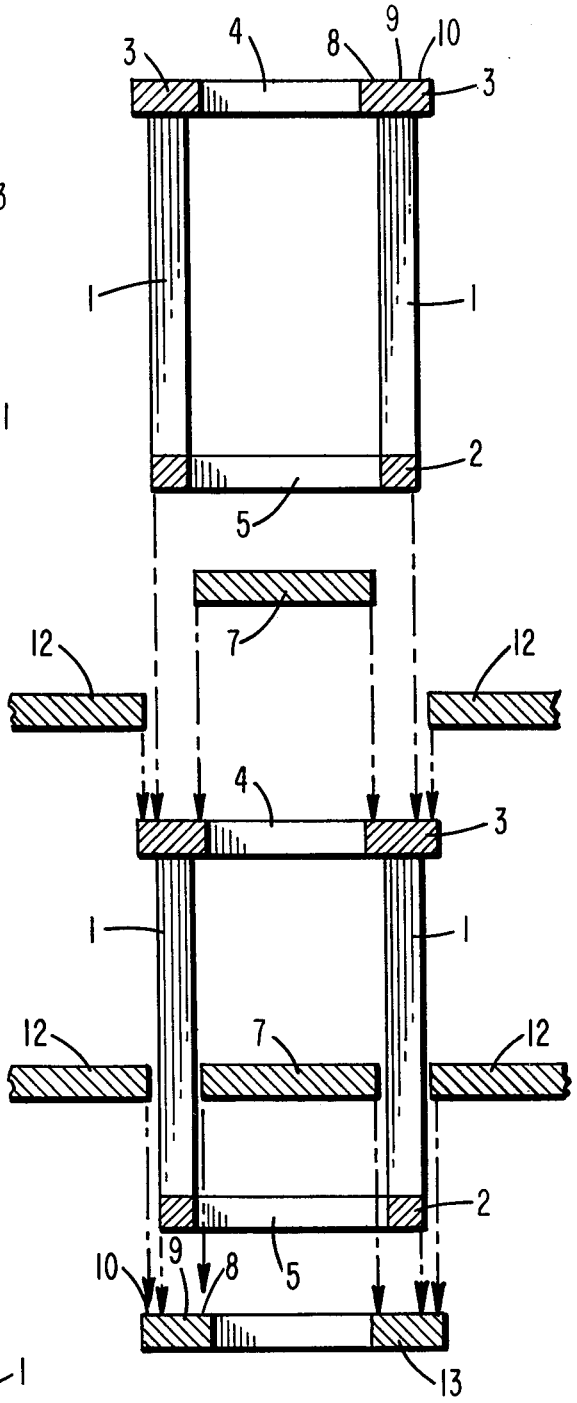
FIG. 2 is a side elevation view of the embodiment of FIG. 1, in stacked condition.

Referring now to FIG. 1 the skeletal structure is composed of four pillars 1 having rectangular shapes which an be solid or hollow and link a lower beam-frame 2 with an upper beam-frame 3. In the upper beam-frame which is larger than the lower beam-frame there exist three zones 8, 9 and 10. Zones 8 and 10 form a lip on which the prefabricated flooring 7, 12 rest (FIG. 2). The skeletal structure has an upper transom 4 extending across upper beam-frame 3 and a lower transom 5 extending across lower beam-frame 2.

In case the skeletal structure is at the base of the assembly the upper beam-frame 3 is substituted at the base floor by a foundation beam-frame 13 having the same three zones as the beam-frame 3.

Figure 3:
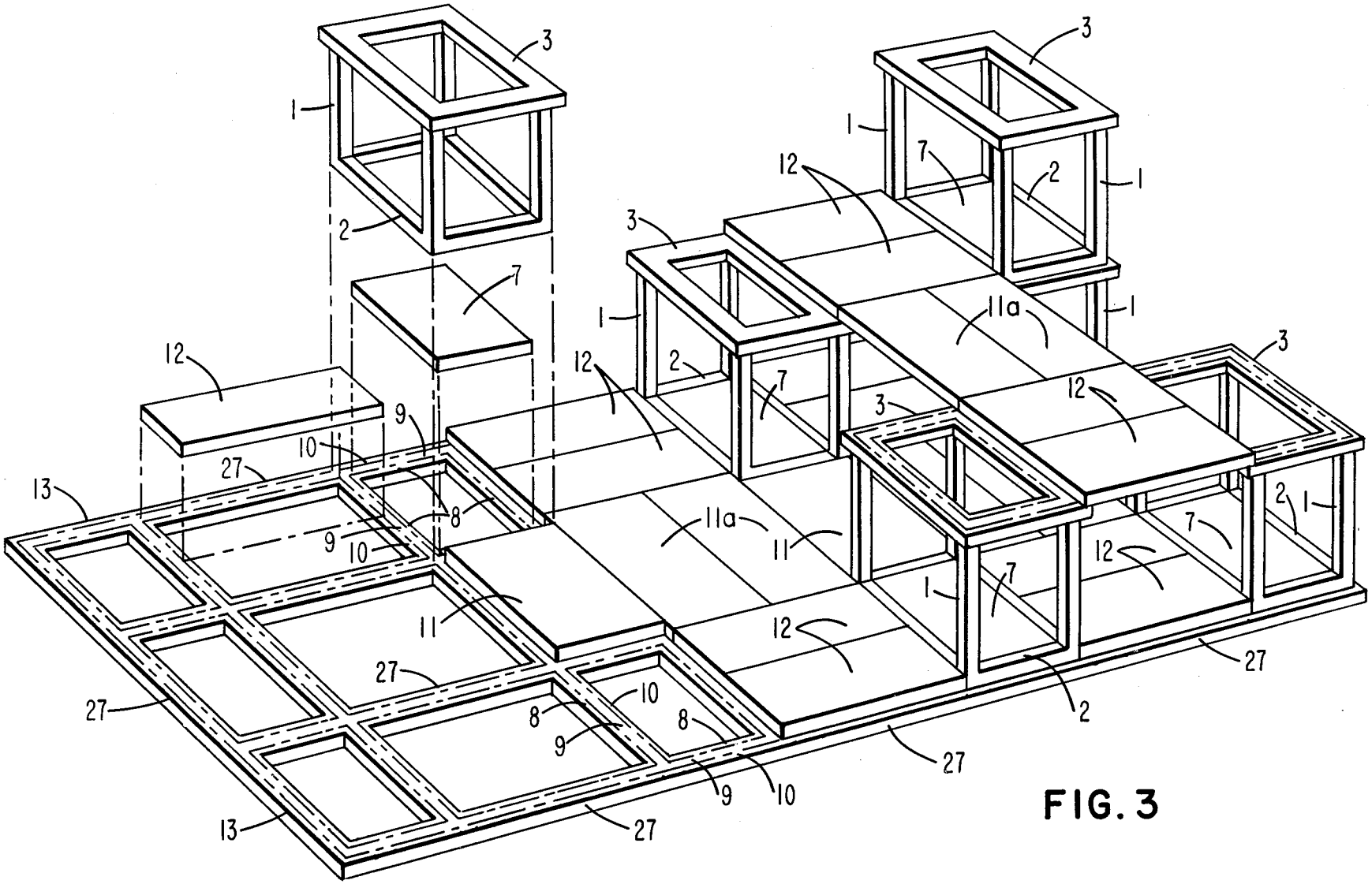
FIG. 3 illustrates the assembly of units of FIG. 1 in forming a multistory structure.

In FIG. 3 the embodiment of FIG. 1 is assembled into a multistory construction with the insertion of interposed floor panels 7, 11, 11*a* and 12.

Foundation beam-frame 13 has three zones 8, 9 and 10 and is united by connecting beams 27. On the internal zone 8 of the foundation beam-frame 13 rest the base floor panels 7, on the central zone 9 the prisms, on the outer zone 10 one side of the floor panels 11, 12 and on the connecting beams the floor panels 11*a*. The assembling of these structures is continued at the upper floors by stacking the prisms on top of each and by arranging the prefabricated flooring.

The assembling of the structures is made by resting the floor panels 7, 11, 12 and 11*a* and the prisms which are space-wise arranged in the two directions on the beam-frame 13.

The floor panels 7 then are placed on the zone 8 of the upper beam-frame 3 and the floor panels 11, 12 and 11*a* are placed on the outer zone 10.

The above described structure is distinguished by having an upper bearing beam-frame and a lower bearing beam-frame, that has only a connecting function. These structures can be assembled in stacked or in alternate form in three directions.

When it is necessary for a lower floor panel to be incorporated with the lower beam-frame, then the upper beam-frame is made without the inner zone 8.

Figure 4:
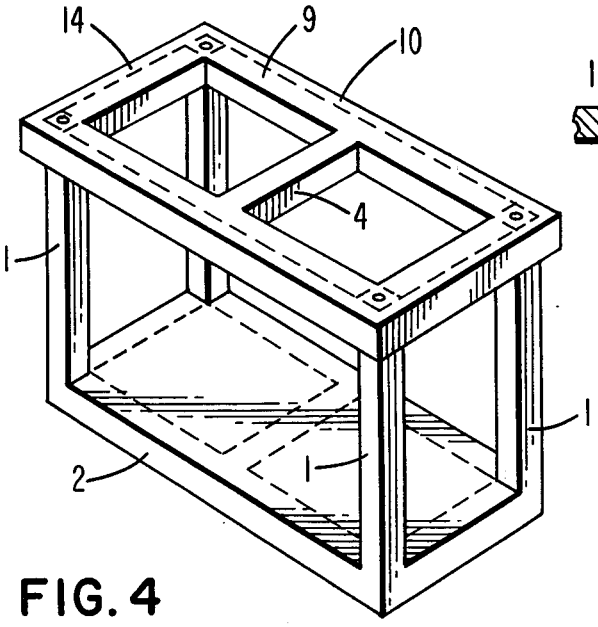
FIG. 4 is a perspective view of a second embodiment of the invention.
Figure 5:
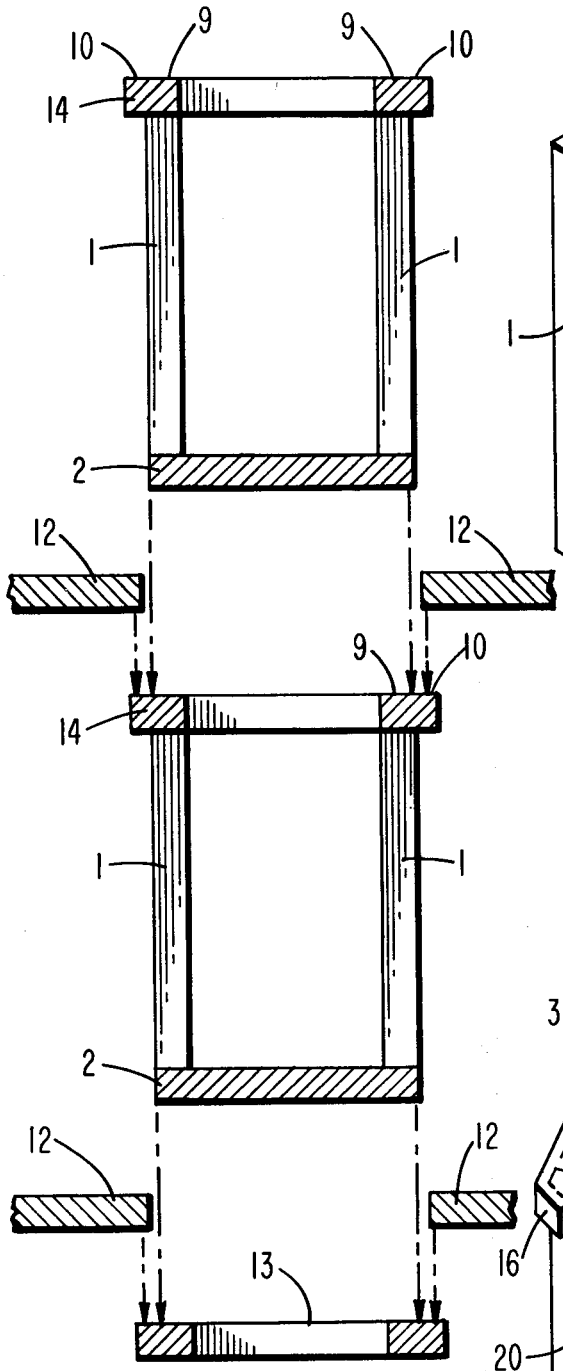
FIG. 5 is a side elevation view of the embodiments of FIG. 4 in a stacked condition.

FIGS. 4 and 5 illustrate this structural form. In FIGS. 4 and 5 the prismatic structure has a rectangular upper beam-frame and a lower base with a floor panel incorporated in the beam-frame 2. The upper beam-frame 14 consists of two zones. The wider inner zone 9 has the floor panel rest thereon while the outer zone 10 has floor panels 11 and 12 rest thereon.

Figure 6:
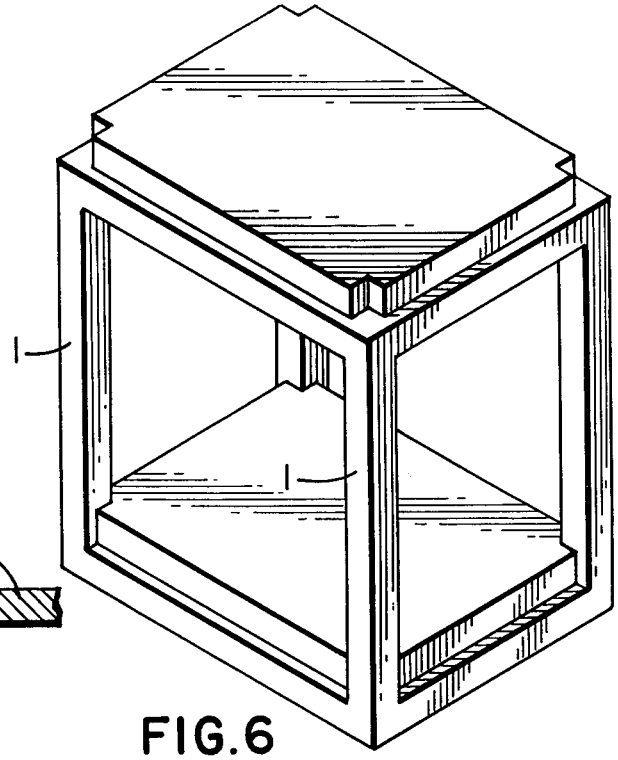
FIG. 6 is a perspective view of a third embodiment of the invention.

Sometimes for constructional reasons it becomes desirable to produce structures in the factory in which the upper and lower floor panels are incorporated in the respective beam-frames as shown in FIG. 6. These structures must be assembled alternatively not stacked.

In addition to prisms having rectangular bases the invention also contemplates prisms having triangular, rhomboidal and trapezoidal bases. The advantage of these structures lies in the fact that, though having a maximum width equal to that allowed by transportation laws, they also have a span between the pillars, greater than that offered by the present box-like parallelepiped structures.

Figure 7:
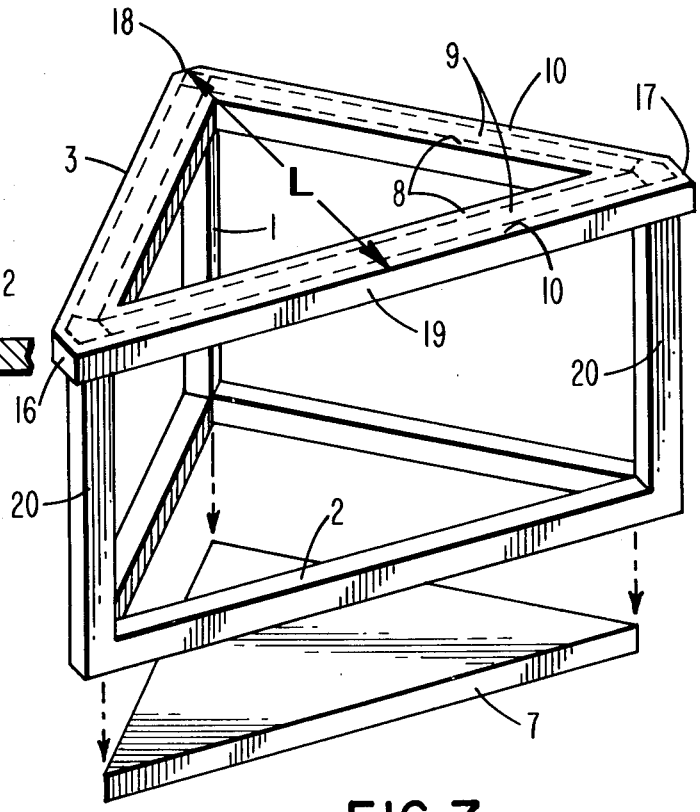
FIG. 7 is a perspective view of a fourth embodiment of the invention.

This is demonstrated in FIG. 7, which shows an isosceles right triangule prism with vertices 16, 17 and 18 whose height L between 18 and 19 is equal to the maximum width allowed for transportation (for example eight feet).

The side connecting the vertices 17 and 18 has a length $L\sqrt{2}$ that is almost one and a half times that of height L, which if L is eight feet would be practically twelve feet.

FIG. 7 describes upper beam-frame 3 with zones 8, 9 and 10 united by means of pillars 1 and 20 to lower beam-frame 2. The structure allows the support of the floor panels 12 on zone 10 on upper beam-frame 3 and the floor panel 7 placed within the lower beam-frame 2.

Figure 8:
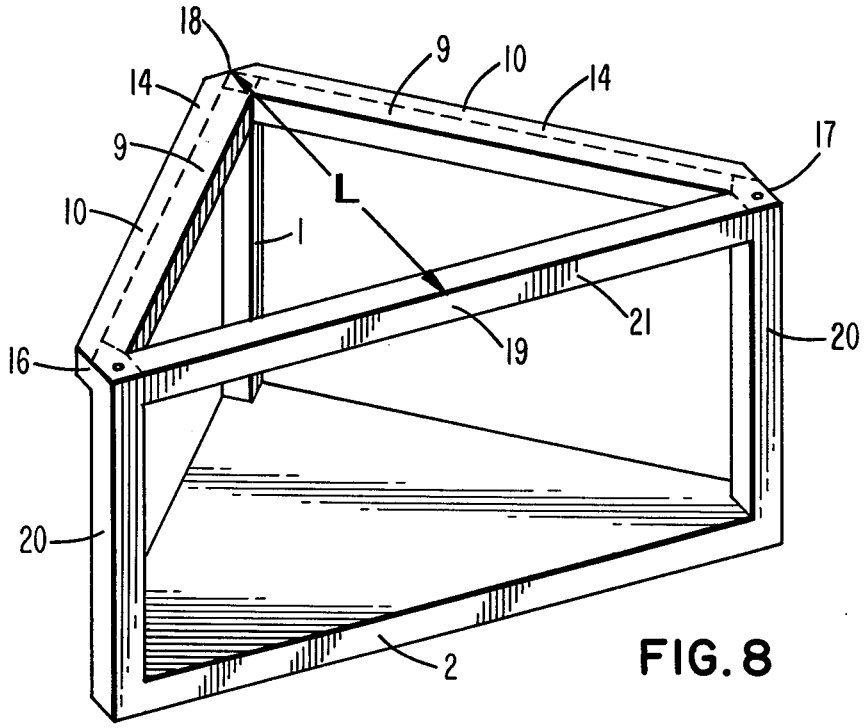
FIG. 8 is a perspective view of a fifth embodiment of the invention.
Figure 9:
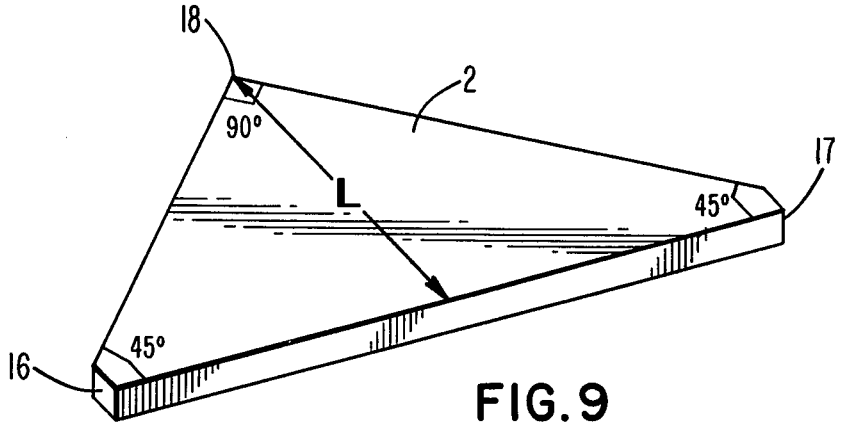
FIG. 9 is a perspective view of a floor plate for the embodiment of FIG. 8.

FIG. 8 shows a reinforced concrete prefabricated structure that is formed by a standard floor panel (FIG. 9) incorporated into the lower beam-frame 2. The pillars 1 and 20 connect the lower base to the upper beam-frame 14 and 21. The beam 21 lacks the zones 8 and 10. The upper and lower bases are isosceles right triangles. The upper base has two beams 14 which have two zones 9 and 10, trimmed at the vertices 16, 17 and 18. The height L - of the upper base is equal to the corresponding height of the lower base.

Such a polyhedron is a prism which bases are isosceles right triangles. Two such prisms may be joined to form a square room by fastening the pillars 20 with pins and bolts or in any known way. The prismatical structure will have a distance between the pillars 1 and 20 of about eleven feet and four inches if L is eight feet.

A prismatic structure with square bases, having spans between the pillars equal, for example, to eleven feet and four inches, could not be transported if built by the present methods of prefabrication.

Figure 10:
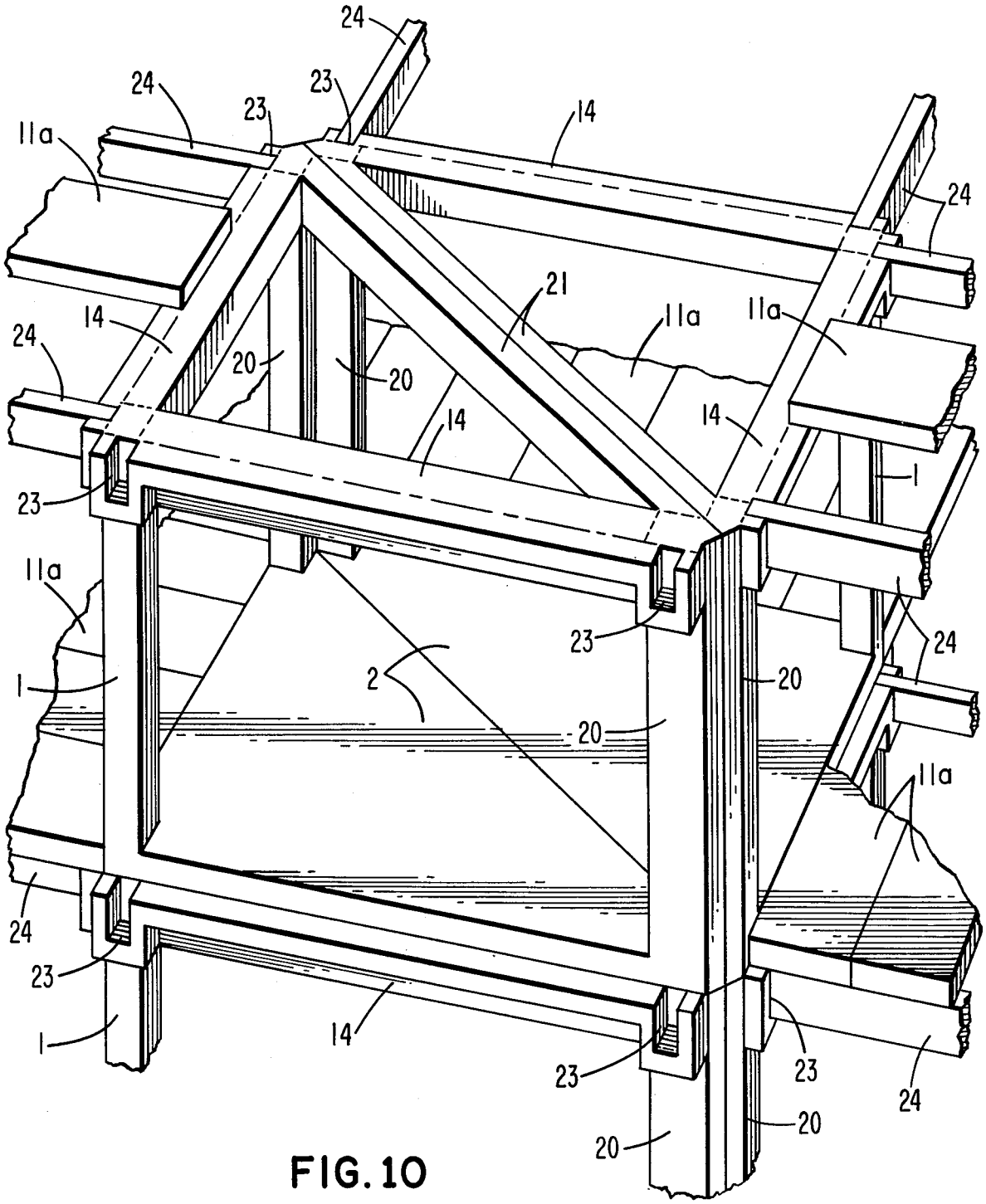
FIG. 10 is a perspective view of a sixth embodiment of the invention.

In FIG. 10 a particular solution for the supporting of floor panels 11*a*, interposed among four prismatic structures of any type is shown.

On each corner of the prism is a bracket with a groove 23, on which rest the beam-frames 24 which support the floor panels 11*a* interposed among four prisms.

Figure 11:
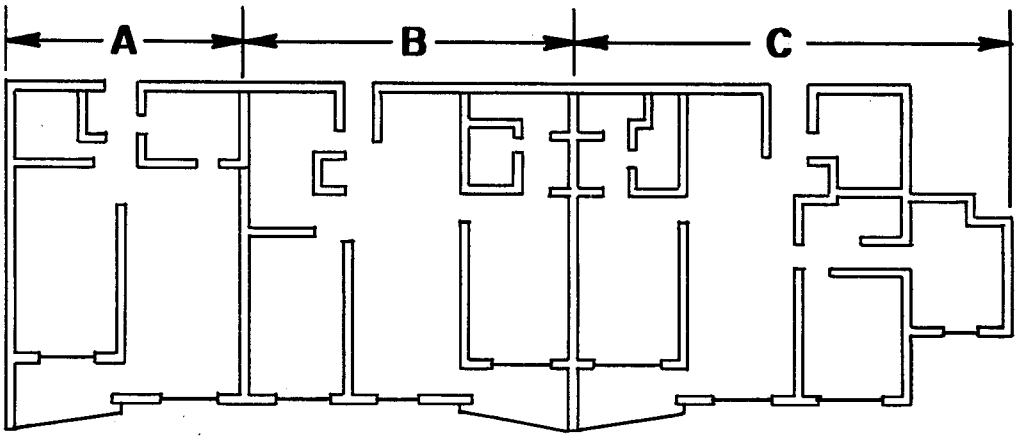
FIG. 11 is a floor plan for a one, two and three bedroom partment in accordance with the invention.

In FIG. 11 is illustrated a condominium apartment complex, taking a selection of one, two and three bedroom apartments designated as A, B, C, respectively.

Figure 12:
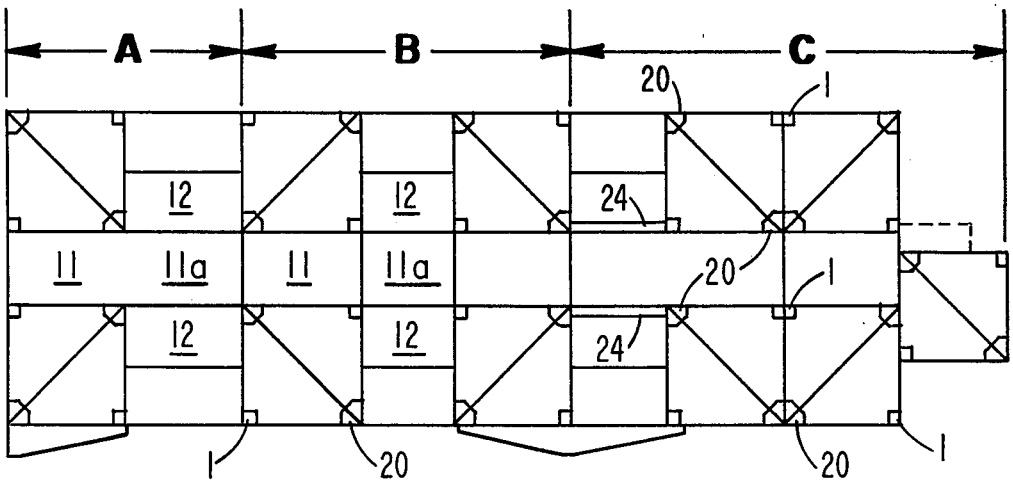
FIG. 12 shows how isosceles triangular prisms may be assembled to form the support structure for the apartments.
Figure 13:
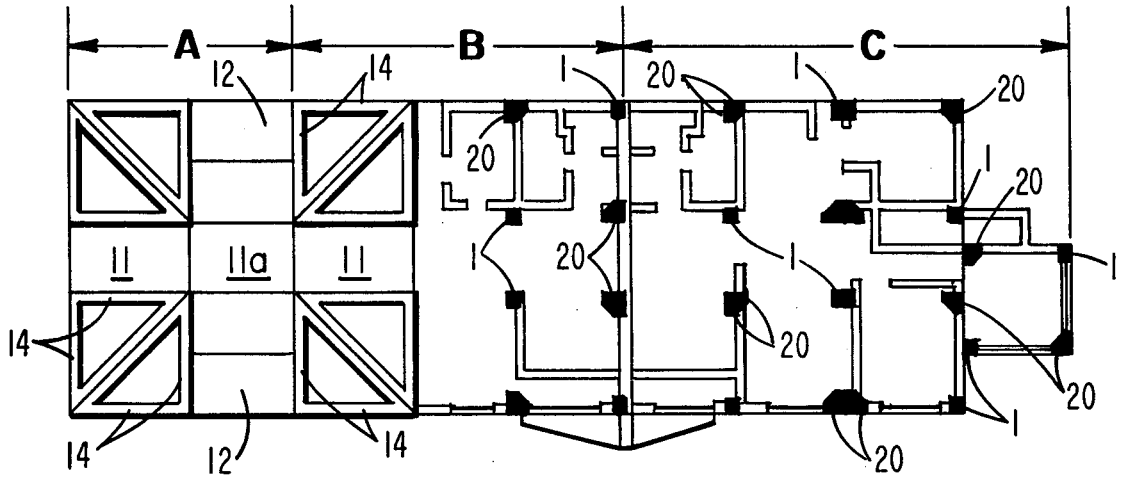
FIG. 13 shows the positioning of the vertical supports of the triangular prisms in relation to the apartments.

By utilizing the junction of isosceles triangular prisms, having a fixed height with relation to the bases, as shown in FIG. 8, several square units can be assembled as in FIG. 12 to form the apartments. The positioning of the pillars in relation to the apartments can be seen in FIG. 13.

Figure 14:
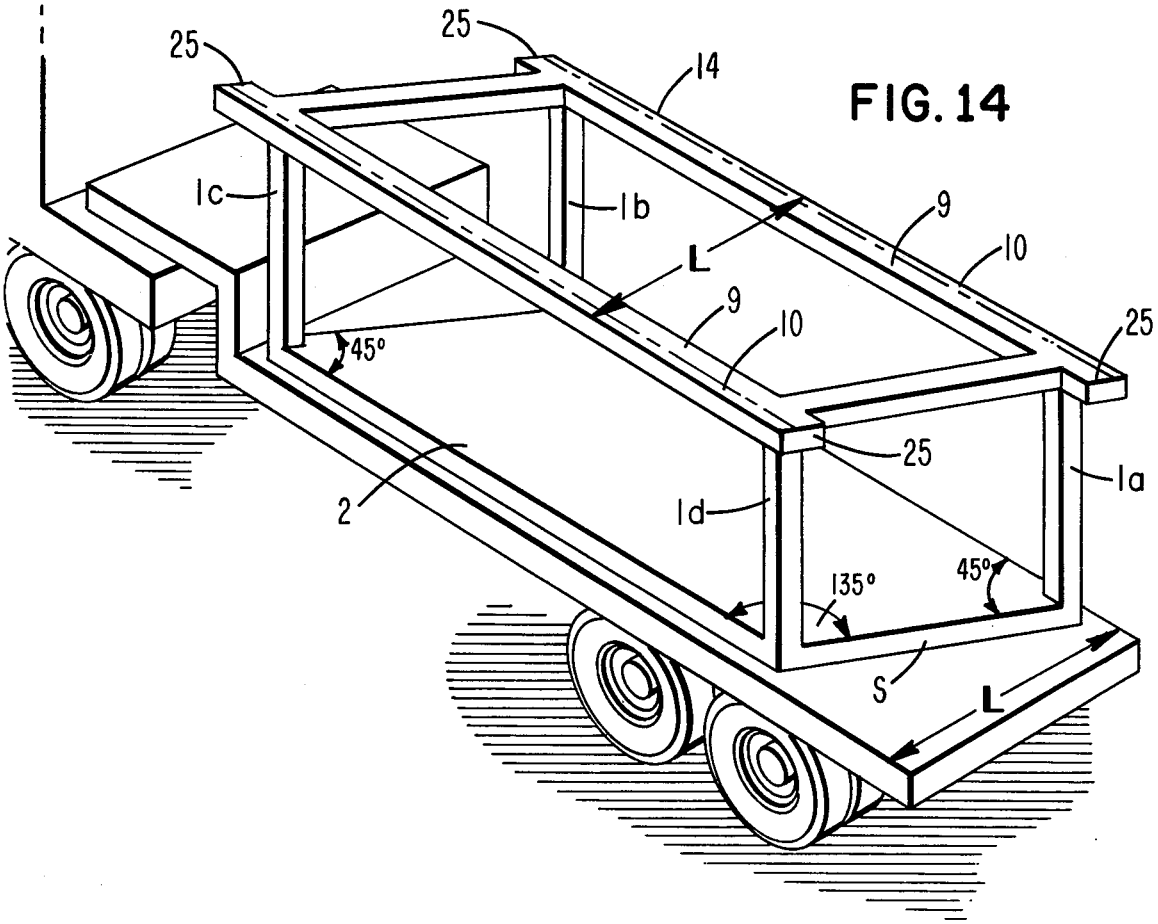
FIG. 14 shows how a seventh embodiment of the invention may be transported.

In FIG. 14 prisms of rhomboidal configuration readily may be transported and still comply with limitations on width of the load.

The rhomboidal prisms may consist of a lower base having a floor panel incorporated into the beam-frame 2, an upper base having the beam-frame 14 containing two zones 9 and 10. Zone 10 overhangs toward the external part of the prism and supports the floor panels 11 and 12. Two such structures are connected to each other by the pillars 1*a*, 1*b*, 1*c* and 1*d* that can be either solid or hollow.

Figure 15:
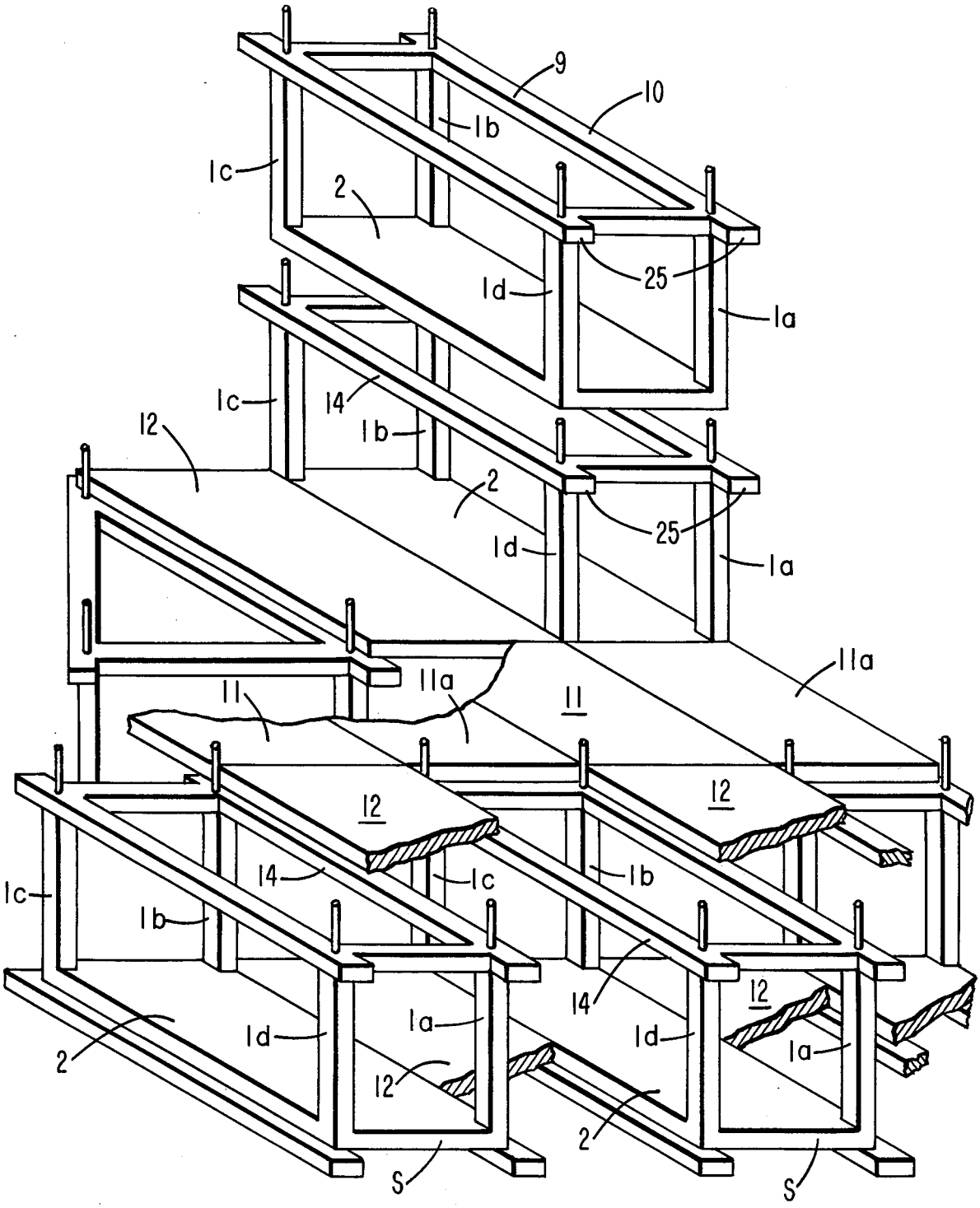
FIG. 15 is a perspective view of the assembly of the embodiment of FIG. 12 in forming a multistory structure.

The brackets 25 that are placed at the end of the upper beam-frame can support monolithic floor panels 11*a*. These brackets can be advantageously substituted by other brackets like those shown in FIG. 10 that have a groove 23 and support the beam-frames 24 which at the same time serve as a support for the floor panels 11*a* interposed among the four prisms. The sides S, connecting the pillars 1*a*, 1*b*, 1*c*, 1*d*, have a span between the pillars greater than L, that is the maximum width allowed for transportation, and that limits the span between the pillars of the present box-type structures. FIG. 15 shows the assembly of rhomboidal prisms.

Figure 17:
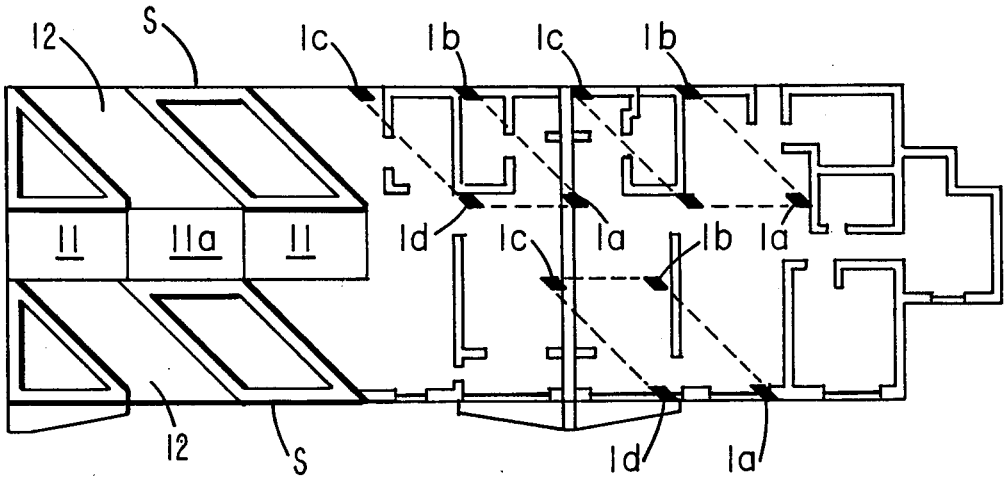
FIG. 17 shows the position of the vertical supports of the rhomboidal prisms in relation to the apartments of FIG. 11.
Figure 16:
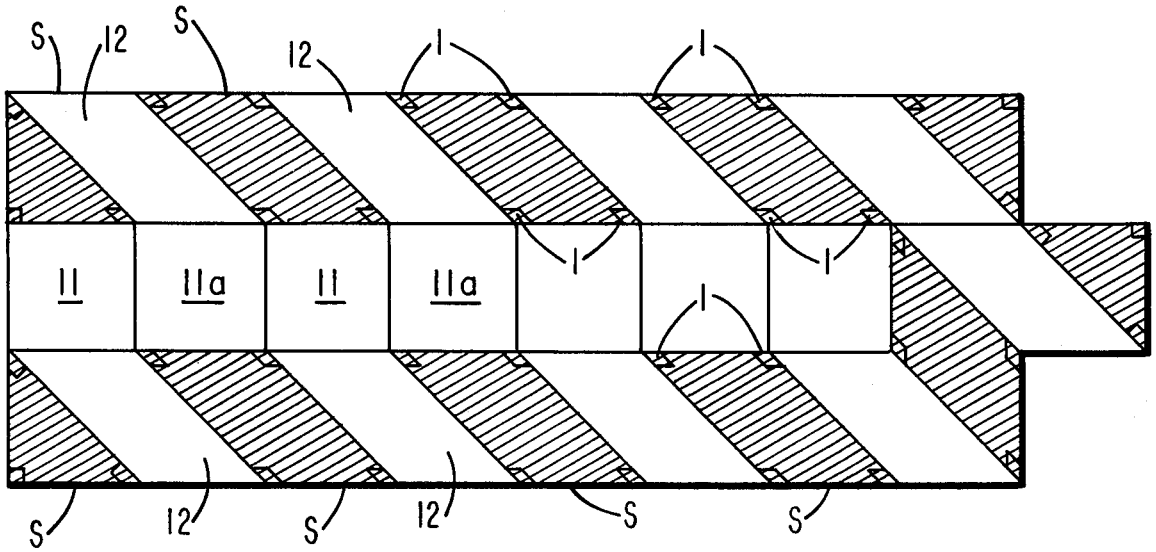
FIG. 16 shows how the rhomboidal prisms may be assembled to form the support structure for the apartments of FIG. 11.

FIGS. 16 and 17 indicate the assembling of the rhomboidal structures in order to build the apartments and illustrate the structural plans which will replace the old methods and make the construction possible in accordance with the system of the invention.

The structure and the floor panels 11, 12 and 11*a* and 7 are placed on the foundation beam-frames. The first floor is completed by placing the floor panels 7, 11, 12 and 11*a* among the prisms on the upper beam-frames. For the next floors the prisms are assembled in a stacked form.

To obtain rectangular spaces inside the modules, triangular prisms or trapezoidal prisms are placed at the corners of the construction.

FIG. 16 indicates at a height of eight feet, the arrangement of the triangular and rhomboidal structures having the span S—between the pillars. The left side of FIG. 17 shows in plan with outlining the shape of the upper beam-frames, on which rest, as previously described, the floor panels 11, 12 and 11*a*. The right side indicates the position of the pillars when the assembling is finished, and the division obtained with partition walls of the apartments above described.

While there have been shown and described preferred embodiments of the structure in accordance with the invention, it will be appreciated that many changes and modifications may be made therein without, however, departing from the essential spirit of the invention.

What is claimed is:

1. Prefabricated skeletal monolithic concrete building structure comprising at least three pillars connecting a lower base and an upper floor base, said bases having equal polygonal shapes, said upper base defining a lip which overhangs the inside dimensions of the pillars and the lower base and a plurality of U-shaped grooved brackets attached to the outside of the upper base outside of the outer dimensions of the pillars.

2. The structure of claim 1 wherein said lower base is integral with a floor within said base.

3. The structure of claim 1 wherein the polygonal shape is a triangle.

4. The structure of claim 1 wherein the polygonal shape is a rhomboid.

5. The structure of claim 1 wherein the polygonal shape is a trapezoid.

6. A construction system comprising a plurality of structures of claim 1 positioned vertically on top of each other.

7. A construction system comprising a plurality of structures of claim 1 positioned alternatively in a horizontal and upward direction.

8. The structure of claim 1 including a separate floor unit positioned within said lower base and level therewith.

9. The structure of claim 1 including a separate floor unit positioned on said lip.

10. A construction system comprising a plurality of structures of claim 1 spaced from each other and including beams seated within said brackets interconnecting said structures.

11. The structure of claim 3 in the form of an isosceles right triangle in which the U-shaped brackets are positioned only on the sides of equal length and the smallest dimension is eight feet or less.

* * * * *